US006783219B2

(12) United States Patent
Lui et al.

(10) Patent No.: US 6,783,219 B2
(45) Date of Patent: Aug. 31, 2004

(54) INK CARTRIDGE

(75) Inventors: Pui Kuong Lui, Kowloon (HK); Zhao Hui Tang, Kowloon (HK); Yiu Cheong Law, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 0 days.

(21) Appl. No.: 10/304,684

(22) Filed: Nov. 27, 2002

(65) Prior Publication Data

US 2004/0100537 A1 May 27, 2004

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,526,030 A * 6/1996 Baldwin et al. ..... 347/87
5,841,454 A * 11/1998 Hall et al. ..... 347/87
6,186,620 B1 * 2/2001 Hsieh et al. ..... 347/84
6,394,593 B1 * 5/2002 Komplin et al. ..... 347/86
6,478,415 B2 * 11/2002 Barinaga et al. ..... 347/85
6,494,568 B2 * 12/2002 Hou et al. ..... 347/86

* cited by examiner

*Primary Examiner*—Anh T. N. Vo
(74) *Attorney, Agent, or Firm*—Rosenberg, Klein & Lee

(57) ABSTRACT

An ink cartridge includes a hollow ink tank body defining an accommodating chamber therein. The ink tank body has an ink outlet port and a mounted seat being formed on a bottom surface thereof. A cover member has an ink filling inlet formed therein. The cover member is fixedly secured to the hollow ink tank body and sealing the accommodating chamber of said hollow ink tank body. A pressure regulator is mounted on the mounted seat and has a box body, an elastic member, and a cover body. As a result of a negative pressure will increase during printing, the elastic member will change its shape and allow air pass through it unidirectional, and because the elastic member has an elastic force, the ink tank still maintains a certain amount of negative pressure and thereof the ink will not leak through the pressure regulator to outside.

5 Claims, 5 Drawing Sheets

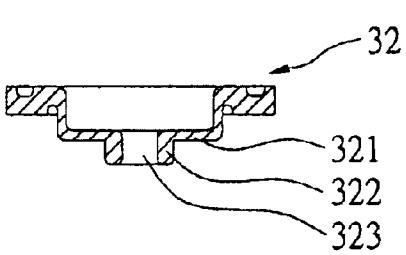
FIG. 4
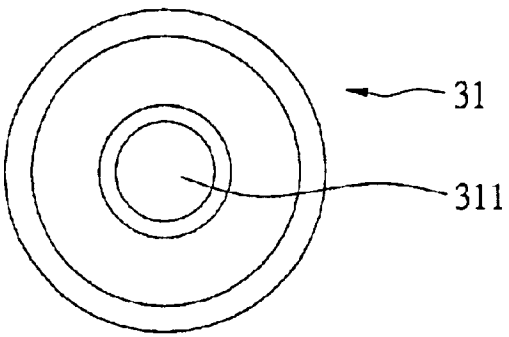
FIG. 5
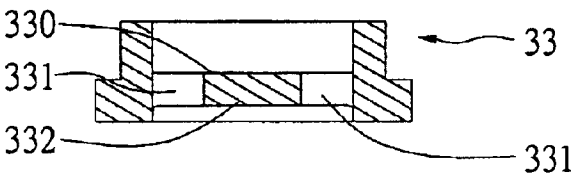
FIG. 6
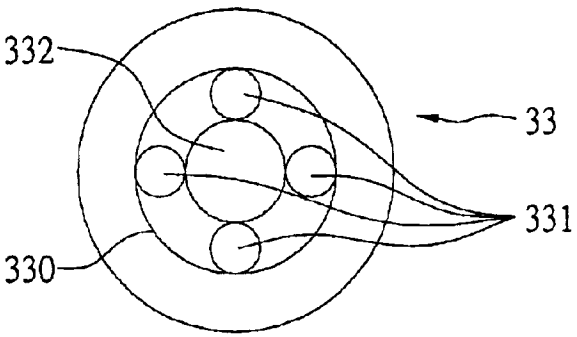
FIG. 7
FIG. 8
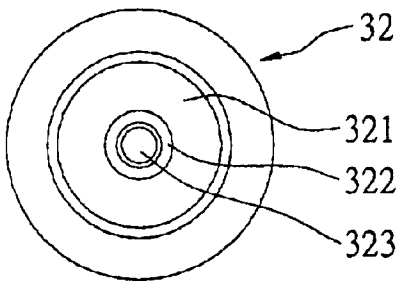
FIG. 9

INK CARTRIDGE

BACKGROUND OF THE INVENTION

1. Field of the Invention

The present invention relates to an ink cartridge suitable for an ink jet printer, and particularly to an ink cartridge having a pressure regulator with an elastic member therein, thereby to allow air enter the ink tank and prevents ink or air exit from the ink tank.

2. Description of the Prior Art

In the conventional ink jet printer, the ink is loaded in an ink cartridge for supplying the ink to an ink delivery needle of the ink jet printer due to print paper. Referring to FIG. 1, the ink cartridge generally comprises an ink tank having an ink tank body la or a plurality of ink tank bodies for loading different color ink, wherein the ink tank body 1*a* is sealed with a cover lid 2*a* thereon. The cover lid 2*a* has an ink filling inlet 20*a* and an ambient air vent 21*a* and a sealing film 22*a* is attached on a top surface of the cover lid 2*a* so as to seal the ambient air vent 21*a* and the filling inlet 20*a*. The ink tank body la has a bottom surface disposed with an ink outlet part 10*a*, and an accommodated chamber thereof positioned with an ink porous member 3*a* therein. A filter 11*a* is affixed to the inner end of the ink tank. Furthermore, firstly to remove the sealing film 22*a*, then to mount the ink cartridge into the ink jet printer, and the ink in fluid communication through the ink outlet part 10*a* of the ink tank body 1*a* to the ink delivery needle 6*a* of the ink jet printer. In the conventional ink cartridge, the top surface of the cover lid 2*a* is formed with a circuitous channel 23*a* (shown in FIG.2) that is extended with a long distance channel due to the ambient air vent 21*a* for ventilation. Additionally, the ink tank must be ventilated in order to equalize pressure differences for the printer to work properly, however, the ventilation of the ink cartridge often results in some of the ink evaporating during use or unused condition, especially if the ink cartridge is used infrequently.

The porous member 3*a* in the ink tank acts as a wick, so that the porous member 3*a* absorbs all ink and wick ink towards the ink delivery needle 6*a*. The filter 11*a* is provided for filtrating some parts departed from the porous member 3*a* to prevent some material of the porous member 3*a* obstructed the ink outlet part 10*a* or the ink delivery needle 6*a*.

Therefore, the conventional ink cartridge has some disadvantages what follows:

1. The cover lid 2*a* has a complex top surface due to the circuitous channel 23*a*.
2. The ink in the ink cartridge is evaporated easily due to the ambient air vent 21*a*.
3. The porous member 3*a* absorbs much ink that will hold up therein and could not be used.
4. If the cartridge is recycled for using again, the porous member 3*a* must be discarded, and clean the ink tank body la and the filter 11*a*, so that it will pollute the environment.

SUMMARY OF THE INVENTION

The primary purpose of the present invention is to provide an ink cartridge which can provide a pressure regulator with an elastic member therein for unidirectional ventilation by a pressure difference between inside and outside, no air inlet hole is required, whereby the ink in an ink tank can be efficiently flowed out through an ink outlet part to an ink delivery needle of the ink jet printer and will not leak out.

Another purpose of the present invention is to provide an ink cartridge that does not require a porous member to hold up the ink, therefore tremendous reduction on production cost and also reduce the waste of ink which is already absorbed by the porous member.

Moreover, it is an environmental friendly user in term of recycling the ink cartridge, no cleaning process is required and certainly don't have to worry about the used porous member and unused ink will pollute the environment. It just needs to simply fill in the ink through the ink filling hole.

In accordance with one aspect of the present invention, an ink cartridge comprising a hollow ink tank body defining an accommodating chamber therein, the ink tank body has an ink outlet port and a mounted seat being formed on a bottom surface thereof. A cover member having an ink filling inlet formed therein, the cover member being fixedly secured to said hollow ink tank body and sealing said accommodating chamber of said hollow ink tank body. A pressure regulator is mounted on the mounted seat and comprising a box body, an elastic member, and a cover body.

As a result of a negative pressure will increase during printing, the elastic member will change its shape and allow air pass through it unidirectional, and because the elastic member has a elastic force, the ink tank still maintains a certain amount of negative pressure and thereof the ink will not leak through the pressure regulator to outside.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross-sectional view of the upper part of the pressure regulator.

FIG. 5 is a bottom view of the upper part of the pressure regulator.

FIG. 6 is a cross-sectional view of the lower part of the pressure regulator.

FIG. 7 is a bottom view of the lower part of the pressure regulator.

FIG. 8 is a cross-sectional view of the middle part of the pressure regulator.

FIG. 9 is a bottom view of the middle part of the pressure regulator.

DESCRIPTION OF THE PREFERRED EMBODIMENT

Figure 1:
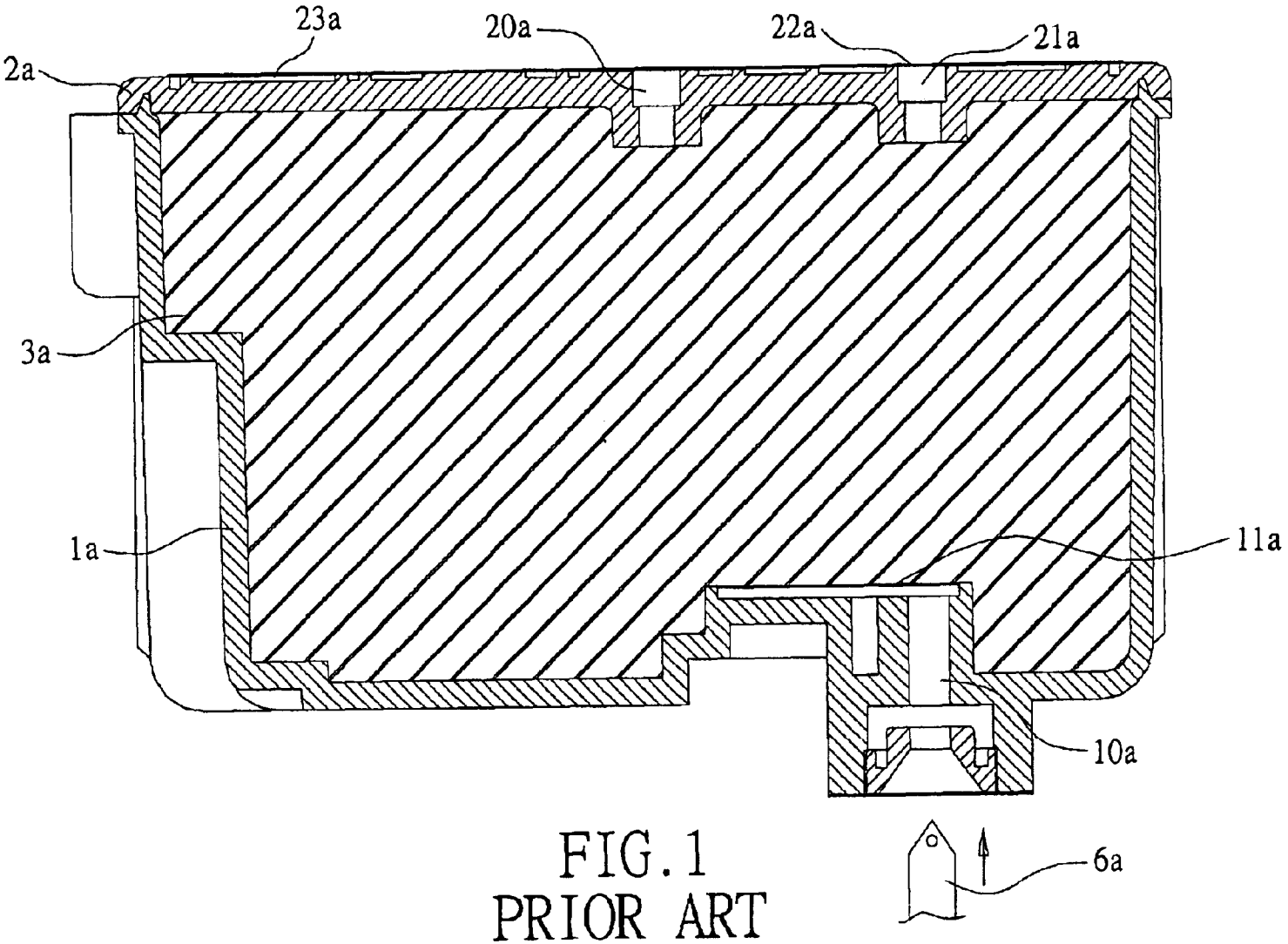
FIG. 1 PRIOR ART
FIG. 1 is a cross-sectional view of prior art.
Figure 2:
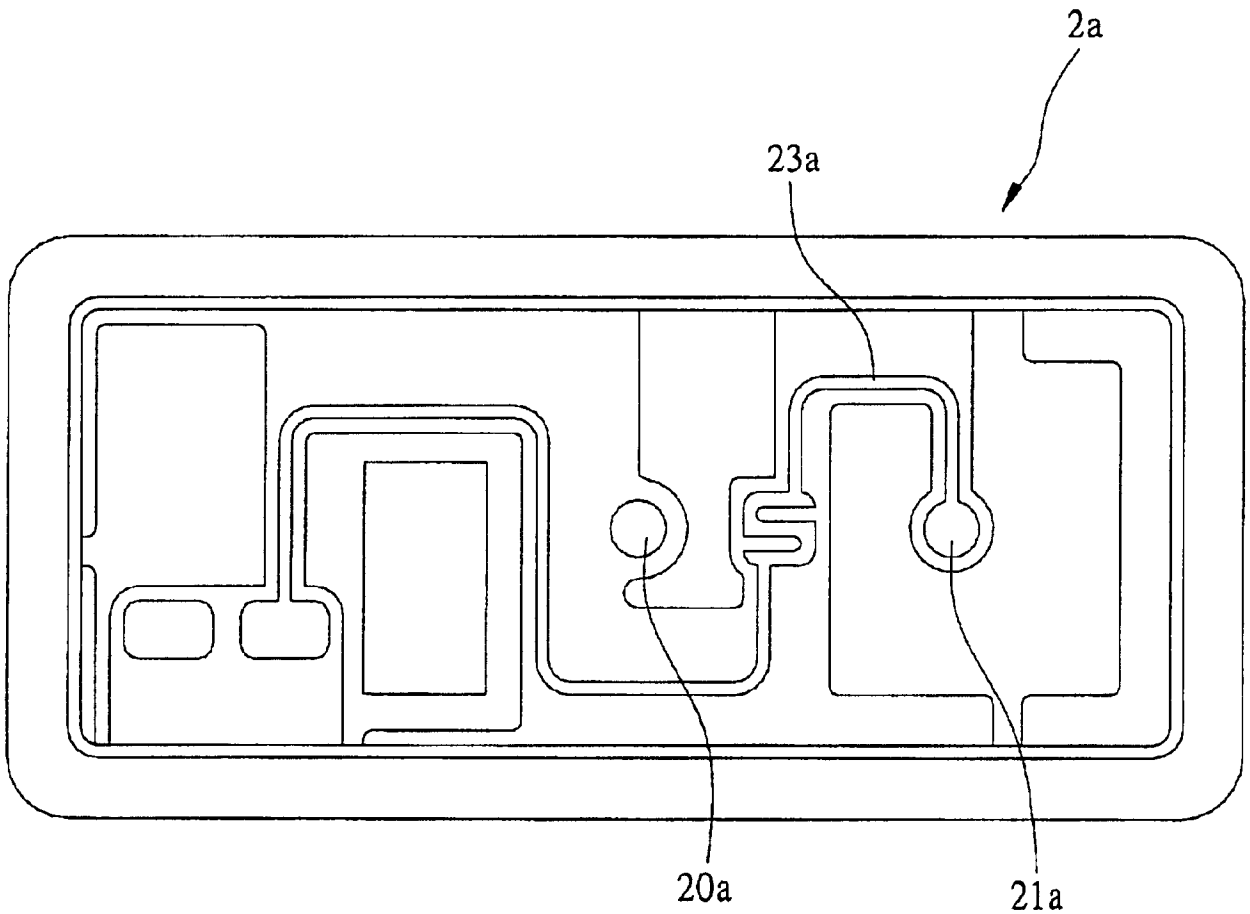
FIG. 2 PRIOR ART
FIG. 2 is a top view of prior art.
Figure 3:
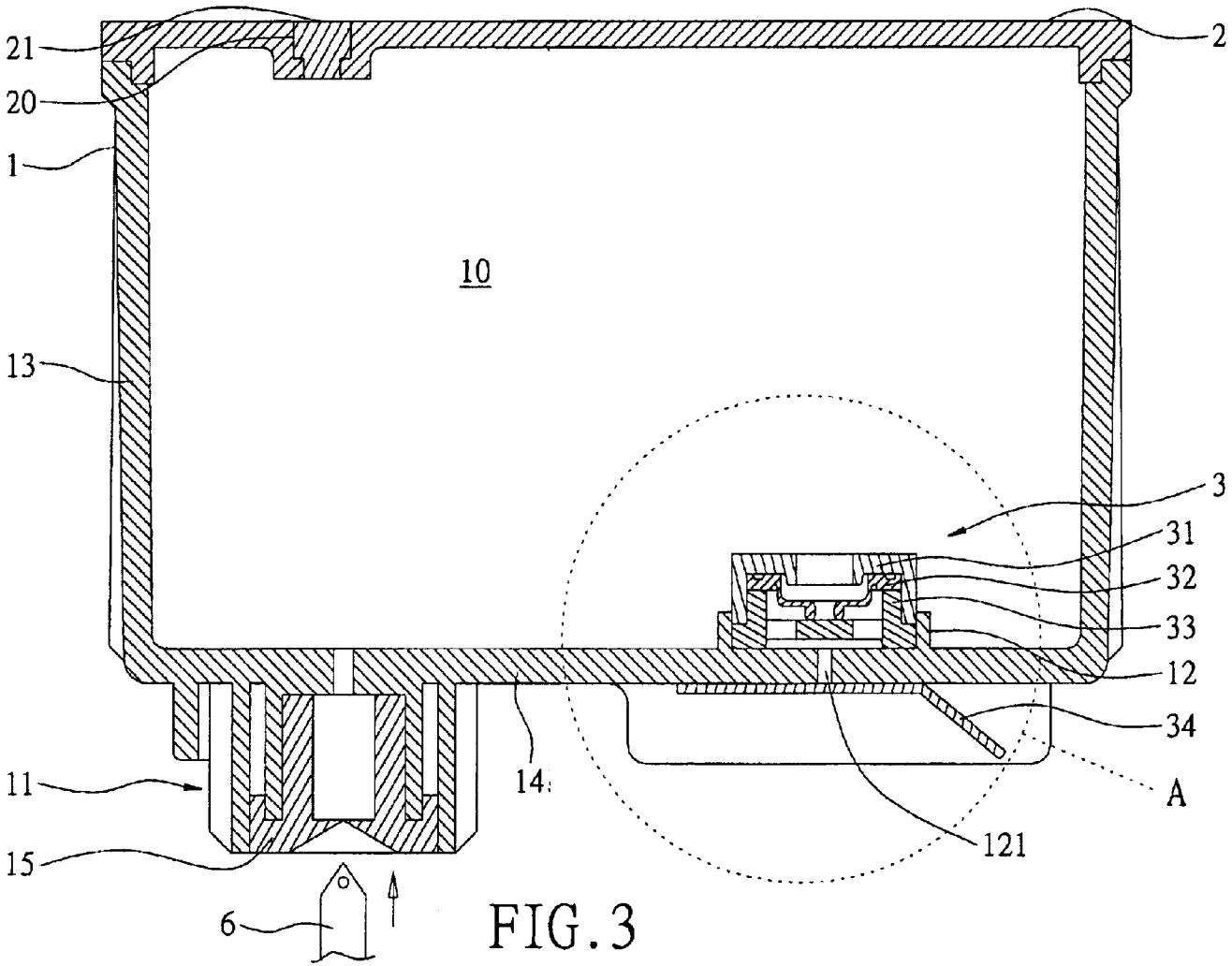
FIG. 3 is a cross-sectional view of the ink cartridge due to the present invention.
Figure 3A:
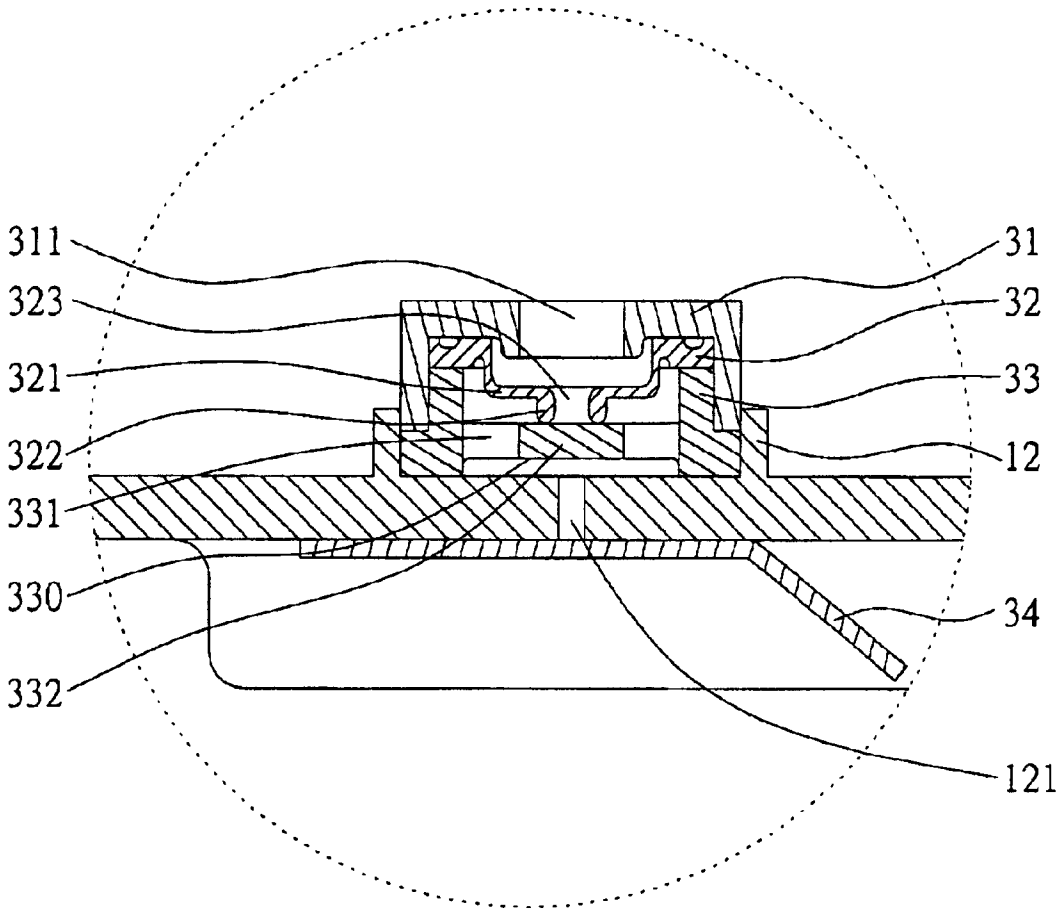
FIG. 3A is a magnified view of the part A of the present invention in FIG. 3.

Referring now to the drawings wherein the showing are for the purpose of illustrating the preferred embodiment of the invention only and not for purposes of limiting same, referring to FIGS. 3 and 3A, an ink cartridge with the present invention comprising an ink tank body 1 disposed with an ink outlet part 11 and a mounted scat 12, a cover lid 2 for covering with the ink tank body 1, and a pressure regulator 3 mounted on the mounted seat 12.

The ink tank body 1 comprises a plurality of surfaces 13 and a bottom wall 14 defining an accommodating chamber 10 due to single color ink or several accommodating spaces due to multi-color ink. The ink outlet part 11 is disposed on the bottom wall 14 can provide the ink flowed to an ink delivery needle 6 of an ink jet printer, and has a fitting element 15 fitted the ink delivery needle 6.

The cover lid 2 has an ink filling inlet 20 sealed with a sealing element 21 is sealed therein after filling ink.

The pressure regulator 3 is mounted on the mounted seat 12 which protruded inwardly from the bottom wall 14 of the ink tank body 1 with a ventilated hole 121. A sealing film 34 is attached on the bottom wall 14 of the ink tank body 1 so as to seal the ventilated hole 121. The pressure regulator 3 comprises an upper part of box body 31, a middle part of elastic member 32, and a lower part of cover body 33. The upper and lower parts are constructed by rigid material, the middle part is made by non-rigid/elastic/flexible material. Referring to FIGS. 4 to 9, the box body 31 has an opening 311 thereon. The cover body 33 has an inner layer 330 formed one or more air hole, in this embodiment are four symmetrical air holes 331 on a periphery thereof defining a platform 332 between said air holes 331 thereon. The elastic member 32 has a valve layer 321 formed a ring 322 thereon defining a central hole 323. The ring 322 is placed on and sealed the platform 332 of the cover body 33.

When the user removes the sealing film 34 from the bottom of ink cartridge, the pressure regulator 3 will allow the air pass through it if required. For example, after mounting the ink cartridge into the ink jet printer, the negative pressure will increase during printing, then, the elastic member 32 of the pressure regulator 3 will change its shape because of the value layer 321 was drawn in by the force caused from the pressure difference. In detail, the ring 322 will shrink apart the platform 332 and result in a gap between the ring 322 and the platform 332 to let air flow in. The air will flow through the ventilated hole 121 of the bottom wall 14, the air holes 331 of the cover body 33, the gap between the ring 322 and platform 332, the central hole 323 of the elastic member 32, and the opening 311 of the box body 31, then, into the accommodating chamber 10. Because the valve layer 321 is elastic, it has an elastic force and the ink tank is still maintain a certain amount of negative pressure and thereof the ink will not leak through the pressure regulator 3 to outside.

One of the advantages of the present invention is that the ink cartridge does not require the porous member to hold up the ink and no filter is required near the ink outlet part, therefore tremendous reduction on production cost. It also reduces the waste of ink that is already absorbed by the porous member so that increases the total amount of printing quantity. Additionally, the pressure regulator on the bottom wall is used instead of the circuitous channel on the cover lid, thereby the ink will not evaporate during use resulted from the ventilation of the ink cartridge. The only one hole is required on the cover lid is for ink filling, so the structure of cover lid is easy to manufacture. Furthermore, it is an environmental friendly user in term of recycling the ink cartridge, no cleaning process is required and certainly don't have to worry about the used porous member and unused ink. Simply fill in the ink through the ink filling hole.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. An ink cartridge comprising:

a hollow ink tank body defining an accommodating chamber therein, said ink tank body having an ink outlet port and a mounted seat being formed on a bottom surface thereof;

a cover member having an ink filling inlet formed therein, said cover member being fixedly secured to said hollow ink tank body and sealing said accommodating chamber of said hollow ink tank body; and a pressure regulator mounted on the mounted seat and having a box body, an elastic member, and a cover body, said cover body being constructed of rigid material and having an inner layer formed with at least one air hole on a periphery of the inner layer defining a platform adjacent thereto; whereby as a result of a negative pressure will increase during printing, the elastic member will change its shape and allow air pass through it unidirectional, and because the elastic member has an elastic force, the ink tank still maintains a certain amount of negative pressure and thereof the ink will not leak through the pressure regulator to outside.

2. The ink cartridge as claimed in claim 1, wherein said box body is constructed by rigid material and has at least one opening formed thereon.

3. The ink cartridge as claimed in claim 1, wherein said elastic member is made by non-rigid, flexible material and has a valve layer protruded a ring therein defining a central hole; whereby the pressure regulator is closed because the ring cover the platform, until the value layer is drawn in by the force caused from a pressure difference during a printer using, the ring will shrink apart the platform and result in a gap between the ring and platform to let air flow in.

4. An ink cartridge comprising:

a hollow ink tank body defining an accommodating chamber therein, said ink tank body having an ink outlet port and a mounted seat being formed on a bottom surface thereof;

a cover member having an ink filling inlet formed therein, said cover member being fixedly secured to said hollow ink tank body and sealing said accommodating chamber of said hollow ink tank body; and a pressure regulator mounted on the mounted seat and having a box body, an elastic member, and a cover body, said cover body being constructed of rigid material and having an inner layer formed with four air holes on a periphery of the inner layer defining a platform between said air holes.

5. An ink cartridge comprising:

a hollow ink tank body defining an accommodating chamber therein, said ink tank body having an ink outlet port and a mounted seat being formed on a bottom surface thereof;

a cover member having an ink filling inlet formed therein, said cover member being fixedly secured to said hollow ink tank body and sealing said accommodating chamber of said hollow ink tank body; and a pressure regulator mounted on the mounted seat and comprising a box body, an elastic member, and a cover body; wherein said box body is constructed by rigid material and has at least one opening formed thereon, said cover body is constructed by rigid material and has an inner layer formed at least one air hole on a periphery of the inner layer defining a platform thereon, said elastic member is made by non-rigid, flexible material and has a valve layer protruded a ring therein defining a central hole; whereby the pressure regulator is closed because the ring cover the platform, until the value layer is drawn in by the force caused from a pressure difference during printing, the ring will shrink apart the platform and result in a gap between the ring and platform to let air flow in.

* * * * *